US007344230B2

(12) United States Patent
Moynihan

(10) Patent No.: US 7,344,230 B2
(45) Date of Patent: Mar. 18, 2008

(54) FLUID DROP EJECTION SYSTEM CAPABLE OF REMOVING DISSOLVED GAS FROM FLUID

(75) Inventor: Edward R. Moynihan, Plainfield, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 269 days.

(21) Appl. No.: 10/936,440

(22) Filed: Sep. 7, 2004

(65) Prior Publication Data

US 2006/0050112 A1 Mar. 9, 2006

(51) Int. Cl.
*B41J 2/175* (2006.01)

(52) U.S. Cl. ..... 347/85

(58) Field of Classification Search ..... 347/84, 347/85

See application file for complete search history.

(56) References Cited

U.S. PATENT DOCUMENTS 4,042,937 A * 8/1977 Perry et al. ..... 347/89
4,788,556 A 11/1988 Hoisington et al.
4,940,995 A 7/1990 Hine et al.
4,961,082 A 10/1990 Hoisington et al.
5,189,438 A 2/1993 Hine et al.
5,265,315 A 11/1993 Hoisington et al.
5,485,187 A * 1/1996 Okamura et al. ..... 347/85
5,629,727 A * 5/1997 Erickson ..... 347/85
5,701,148 A 12/1997 Moynihan et al.
5,771,052 A 6/1998 Hine et al.
6,059,405 A * 5/2000 Mochizuki et al. ..... 347/92
6,224,201 B1 * 5/2001 Shigemura ..... 347/93
6,312,119 B1 * 11/2001 Kocher et al. ..... 347/92
6,698,869 B2 * 3/2004 Vosahlo ..... 347/85
6,705,711 B1 * 3/2004 Richards ..... 347/85
2002/0158950 A1 10/2002 Altendorf
2004/0004649 A1 1/2004 Bibl et al.
2005/0099467 A1 5/2005 Bibl et al.

FOREIGN PATENT DOCUMENTS

EP 1 424 205 A1 6/2004
JP 63-145039 6/1988
WO WO 02/28654 4/2002

OTHER PUBLICATIONS

International Search Report and Written Opinion of the International Searching Authority, International Application Serial No. PCT/US2005/031926, Jan 31, 2006, 9 pp.

* cited by examiner

*Primary Examiner*—An H. Do
(74) *Attorney, Agent, or Firm*—Fish & Richardson P.C.

(57) ABSTRACT

A drop ejection system includes a drop ejection head and a reservoir. An air pump produces a partial vacuum above a fluid body in the reservoir to remove dissolved air or vapor in the fluid.

25 Claims, 2 Drawing Sheets

FLUID DROP EJECTION SYSTEM CAPABLE OF REMOVING DISSOLVED GAS FROM FLUID

TECHNICAL FIELD

This application relates to the field of fluid drop ejection.

BACKGROUND

In many ink jet systems, ink is supplied to a chamber or passage connected to a nozzle from which the ink is ejected drop-by-drop as a result of successive cycles of decreased and increased pressure applied to the ink in the passage. The pressure cycles can be generated by a piezoelectric crystal, a heater, or a Micro Mechanical Device. If the ink introduced into the passage contains dissolved air, decompression of the ink during the reduced pressure portions of the pressure cycle may cause the dissolved air to form small bubbles in the ink within the passage. Repeated decompression of the ink in the chamber causes these bubbles to grow and such bubbles can produce malfunctions of the ink jet apparatus. Degassing of ink typically utilizes a semi-permeable membrane that is in contact with the ink on one face of the membrane. Reduced pressure is applied to the other side of the membrane to extract dissolved air from the ink in the ink path.

SUMMARY

In one aspect, the invention is directed to drop ejection system that has a drop ejection head comprising a plurality of nozzles for ejecting a fluid, a first reservoir adapted to hold a fluid and have a space above the fluid, a first fluid path that connects a lower portion of the first reservoir with the drop ejection head, a second reservoir adapted to hold a fluid and have a space above the fluid, a second fluid path that connects a lower portion of the second reservoir with the first reservoir, and an air pump coupled to an upper portion of the second reservoir to produce a partial vacuum in the space above the fluid in the second reservoir.

In another aspect, the invention is directed to a drop ejection system that has a drop ejection head comprising a plurality of nozzles for ejecting a fluid, a reservoir adapted to hold a fluid in its lower portion, a first fluid path that can supply the fluid from the lower portion of the reservoir to the drop ejection head, a first fluid valve that can shut off the fluid connection from the lower portion of the reservoir to the drop ejection head, and an air pump to produce a partial vacuum in the upper portion of the reservoir.

In another aspect, the invention is directed to a method of removing dissolved gas in a fluid ejection system. The method includes providing a fluid in a second reservoir that is in fluid communication with a first reservoir, producing a partial vacuum in a space above the fluid in the second reservoir, supplying the fluid in the second reservoir to the first reservoir, the first reservoir having a space above the fluid, and supplying the fluid in the first reservoir to a drop ejection head.

In another aspect, the invention is directed to a method of removing dissolved gas in a fluid ejection system. The method includes providing a fluid in a reservoir, sealing fluid communication from a lower portion of the reservoir to a drop ejection head, producing a partial vacuum in a space above the fluid in the reservoir, opening the fluid connection, and supplying the fluid in the reservoir to the drop ejection head.

Implementations of any of the above inventions may include one or more of the following features. The partial vacuum may enable the extraction of dissolved air or dissolved vapor from the fluid. A fluid valve may shut off the fluid path from the second reservoir to the first reservoir. A stirring device may stir the fluid to assist the extraction of dissolved air from the fluid. A pump may pump the fluid from the second reservoir to the first reservoir through the second fluid path. The drop ejection head may have a fluid conduit to supply the ink received from the first reservoir to the nozzles. A fluid-feeding path to a reservoir may be closed when the partial vacuum is generated in the upper portion of the reservoir. The drop ejection head may be movable without requiring movement of the second reservoir. A control unit may controls the air pump to produce the partial vacuum. The air pump may be controlled in response to one or more properties of the fluid, to the idle time of the drop ejection head, or to the fluid filling status or the fluid level. The fluid may includes one of more of an ink, a dye-based ink, a pigment-based ink, a hot-melt ink, a colorant containing fluid, a paint, a polymer solution, a solvent, a colloidal suspension, and a metal containing fluid. The drop ejection head may have one or more fluid ejection actuators, e.g., a piezoelectric transducer or a heater, that can actuate the fluid ejection through the nozzles. A surface of fluid in one of reservoirs may control the meniscus pressure at the nozzles in the drop ejection head.

Embodiments may include one or more of the following advantages. The gas dissolved in the fluid of a fluid ejection system is removed using a so called bulk degassing arrangement without using the typical deaerator membranes. The gas in the fluid is removed from the fluid/air interface by a partial vacuum above the fluid body in a sealable fluid container upstream to the fluid ejection head.

The fluid container can be a reservoir that is connected with the fluid ejection head through a fluid path. When the degassing mechanism is arranged in the fluid reservoir, the degassing operations can be conducted without interfering with the fluid ejection operations. The fluid ejection and the degassing operations can both be effective because they can be separately optimized.

The disclosed system is simple, less expensive, and easier to maintain. The system is also effective to ink formulations that contain trace amount of high vapor pressure materials such as water and solvents.

The details of one or more embodiments are set forth in the accompanying drawings and in the description below. Other features, objects, and advantages of the invention will become apparent from the description and drawings, and from the claims.

DETAILED DESCRIPTION

Figure 1:
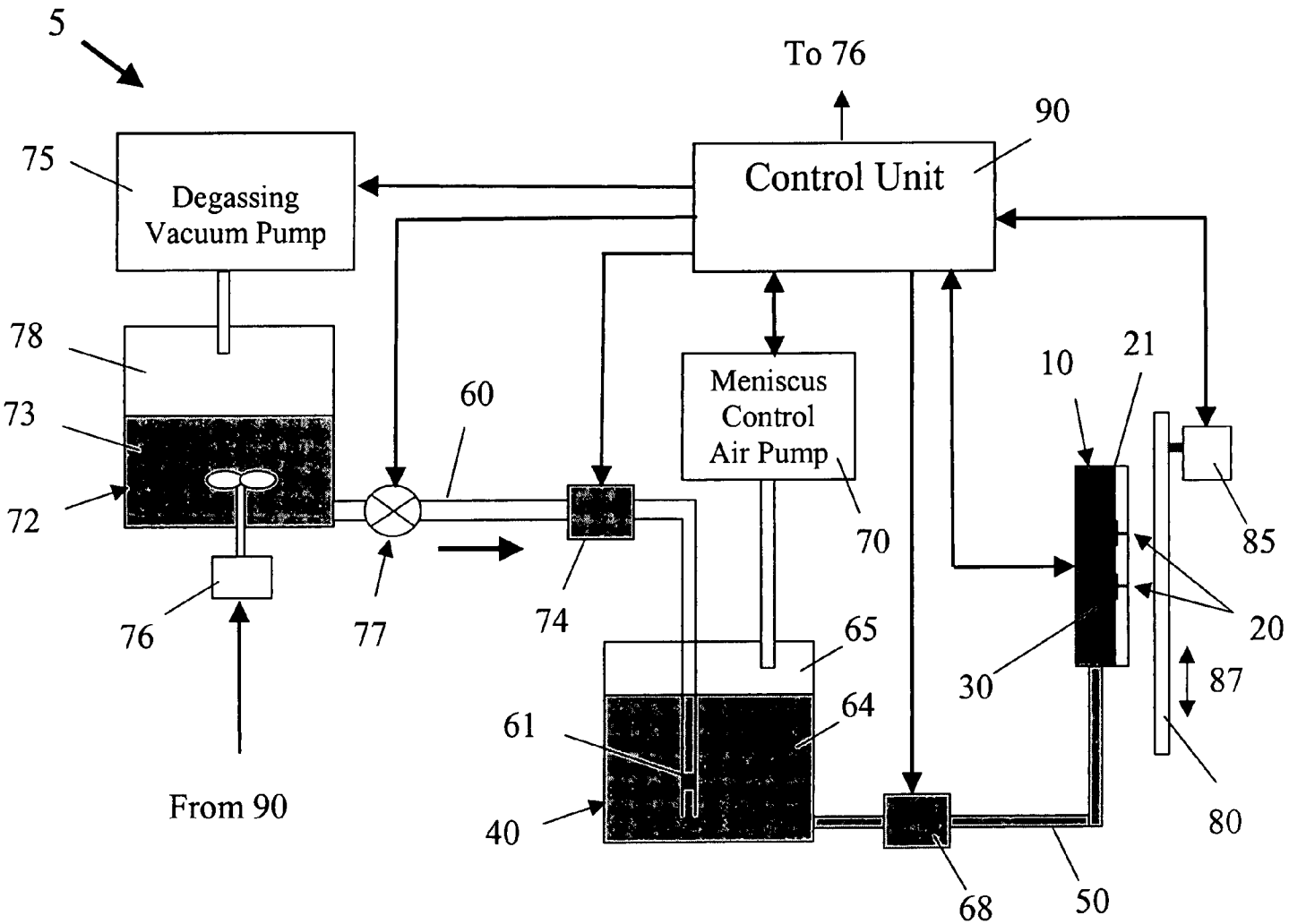
FIG. 1 illustrates an ink jet printing system configured to remove dissolved gas from the ink.

FIG. 1 illustrates an ink in an ink jet printing system 5 having an arrangement for bulk degassing. The ink jet printing system 5 includes an ink jet print head module 10 having a plurality of ink nozzles 20 typically arranged in arrays on a nozzle plate 21, a fluid conduit 30 in the ink jet print head module 10 for supplying ink to the ink nozzles 20, a meniscus control reservoir 40 for storing ink that controls the meniscus pressure in the ink nozzles 20, and an ink passage 50 for supplying ink from the meniscus control reservoir 40 to the fluid conduit 30.

In operation, ink completely fills the fluid conduit 40, e.g., substantially all of the of the walls of the fluid conduit 30 are in contact with the ink fluid. Thus, the ink fluid contained in the fluid conduit 30 has substantially no free surface. In contrast, in operation, ink does not completely fill the meniscus control reservoir 40.

The meniscus control reservoir 40 holds an ink body 64 in its lower portion and a space 65 above. The meniscus control reservoir 40 includes the ink-feeding path 60 having an ink filter 61 that supplies ink to the meniscus control reservoir 40. The ink in the meniscus control reservoir 40 is supplied to the fluid conduit 30 by an ink pump 68 along the ink passage 50. A meniscus control air pump 70 can create a partial vacuum in the space 65 above the ink surface. The height of the ink surface and the partial vacuum in the meniscus control reservoir 40 controls the meniscus of the ink nozzles 20.

The ink jet printing system 5 further includes an ink tank 72 upstream of the meniscus control reservoir 40. The lower portion of the ink tank 72 holds a body of ink 73 that can be pumped by ink pump 74 to the meniscus control reservoir 40 through ink path 60. The ink tank 72 is also not completely full, so that a free surface is formed over the ink body 73. The ink flow from the ink tank 72 to the meniscus control reservoir 40 along the ink path 60 can be shut off by closing a check valve 77. A partial vacuum can then be created in a space 78 above the ink surface by pulling air by a degassing vacuum pump 75. Dissolved gas is removed or extracted from the ink body 73 at the ink surface, which reduces the concentration of the dissolved gas in the ink body 73. The rate of gas removal from the ink body 73 is proportional to the area of its free surface. For example, a large free surface can be formed across the horizontal cross-section of the ink tank 72. A stirrer 76 can stir the ink body 73 during the gas removal to assist the migration of dissolved gas to the ink surface. The operations of the valve 77, the ink pump 74, the degassing vacuum pump 75 and the stirrer 76 are under the control of a control unit 90. The valve 77 can be a check valve, a variable valve, a solenoid valve, a servo valve, etc. The valve 77 can be manually operated in degassing operations.

The gas-removal arrangement described above and shown in FIG. 1 can be referred to as a bulk-degassing system. The result of the degassing operations is that the ink is conditioned so that the relative concentration of any gases or volatile liquids is well below the saturation concentration for those materials at the operating conditions of the ink jet print head module 10. This ensures the best possible priming performance of the ink nozzles 20, and the best possible resistance to rectified diffusion.

In one exemplary embodiment, the ink jet printing system 5 is an industrial printing system. The ink tank 72 is a bulk paint-pot with a 4 liter capacity having one or more internal stirrers. The ink tank 72 is periodically refilled with jugs from the ink manufacturer. The ink tank 72 is sealed and a good vacuum (e.g. at 0.001 Bar) is applied to the entire ink tank 72. The continuous stirring in the presence of the vacuum is sufficient to eliminate any dissolved air or vapor, and to reduce the concentration of all volatile ingredients to below the saturation level. The ink tank 72 can further include a ink feeding path for receiving ink fluid. The ink-feeding path includes a check valve that can be closed to create partial vacuum over the ink body in the ink tank 72 during degassing operations.

The disclosed bulk degassing system not only can remove bubbles of air, it is also especially effective in removing dissolved air and other dissolved high-vapor-pressure materials material (e.g. water, solvents) from the ink body. This is advantageous in comparison to the membrane-based fluid deaerator because the molecules of the high vapor-pressure materials move more readily across the fluid air interface than they do through a membrane. Furthermore, the bulk degassing system and methods disclosed can be applied in combination with a fluid deaerator such as the ones disclosed in commonly assigned U.S. Pat. Nos. 4,788,556, 4,940,995, 4,961,082, 4,995,940, and 5,701,148. The content of these U.S. patents is herein incorporated by reference.

Ink types compatible with the bulk degassing system include water-based inks, solvent-based inks, dye-based inks, pigment-based inks, and hot melt inks. The ink fluids may include colorants such as a dye or a pigment. Other fluids compatible with the system may include polymer solutions, gel solutions, solutions containing particles or low molecular-weight molecules. Unless specific care is taken during manufacturing, inks commonly contain dissolved air at close to saturation concentration. Many inks are likely to contain water and other volatile components such as alcohols and solvents, which may be produced by unintended results of production processes such as stirring in a humid atmosphere or reactions within the ink. For example, some hot-melt inks are known to evolve water over time as a reaction byproduct of certain acids in the formulation. The disclosed system is also compatible with other fluids such as colorant containing fluids, paints, polymer solutions, solvents, colloidal suspensions, and metal containing fluids.

In one embodiment, the partial vacuum created in the ink tank 72 is dependent on one or more properties of the ink. The pressure and duration of the partial vacuum can vary under the control of the control unit 90 in accordance to the propensity of the ink to dissolution of air, or the concentration or generation of water and other volatile components in the ink. In operation, the control unit 90 receives the above and other properties and in response sends signals to the degassing vacuum pump 75 to control the pumping rate and duration, which in turn determines the pressure and the time profile of the partial vacuum.

In another embodiment, gas-removal operations can be dependent on other factors that can impact the level of dissolved air or vapor in the ink body including the idle time of the ink jet printing system 5, the ink filling status and the filling level in the ink tank 72. Gases need to be removed when new ink is added the ink tank 72. Air can also be dissolved into the ink body through ink nozzles 20 etc. if the ink jet printing system stays idle for a period of time.

The ink jet print head module 10 can include a plurality of ink nozzles 20 that are in fluid communication with the fluid conduit 30. Each ink nozzle 20 is associated with one or more ink ejection actuators that can for example include a piezoelectric transducer, a heater, or a MEMS transducer device. The ink jet printing system 5 can further comprise an electronic selector that can select the ink nozzle and the associated ink actuators from which the fluid drop will be ejected. A portion of the fluid conduit 30 adjacent the associate actuator can be widened to provide a pumping chamber (this chamber is also substantially filled by the ink). The ink nozzle 20 in the nozzle plate 21 is connected with an ejection portion of the fluid conduit 30. The ink fluid in the ejection portion of the fluid conduit 30 is ejected from the ink nozzle 20 under the control of the control unit 90. The ejected ink drop can vary in volume in response to different drive voltage waveforms applied to the ink ejection actuator by the electronic control unit 90.

The ink jet print head module 10 can exist in the form of piezoelectric ink jet, thermal ink jet, MEMS based ink jet print heads, and other types of ink actuation mechanisms. For example, Hoisington et al. U.S. Pat. No. 5,265,315, the entire content of which is hereby incorporated by reference, describes a print head that has a semiconductor print head body and a piezoelectric actuator. The print head body is made of silicon, which is etched to define an ink fluid conduit. Nozzle openings are defined by a separate nozzle plate 21, which is attached to the silicon body. The piezoelectric actuator has a layer of piezoelectric material, which changes geometry, or bends, in response to an applied voltage. The bending of the piezoelectric layer pressurizes the ink fluid near the ejection portion of the fluid conduit, e.g., in the pumping chamber located along the ink path.

Other ink jet print heads are disclosed in commonly assigned U.S. patent application Ser. No. 10/189,947, U.S. Patent Publication No. US20040004649A1, titled "Printhead", filed on Jul. 3, 2002, and in commonly assigned U.S. Provisional Patent Application No. 60/510,459, titled "Print head with thin membrane", filed Oct. 10, 2003. The content of these related patent applications and publications are herein incorporated by reference.

The ink jet printing system 5 can also include a mechanism 85 that transports an ink receiver 80 along a direction 87. In one embodiment, the ink jet print head module 10 can move in reciprocating motion driven by a motor via an endless belt. The direction of the motion is often referred to as the fast scan direction. The ink jet print head is scanned relative to the ink receiver 80 without requiring moving the meniscus control reservoir 40. At least a portion of the ink path 60 is flexible such that the ink jet print head module 10 can be moved without the movement of the ink tank 72. The advantage of a separate ink tank 72 from the ink jet print head module 10 is that the gas or vapor dissolved in the ink can be removed without interfering with the movement or printing operations of the ink jet print head module 10.

A second mechanism can transport the ink receiver 80 along a second direction (commonly referred as the slow scan direction) that is perpendicular to the first direction. During printing, ink drops are ejected from the ink nozzles 20 under the control of an electronic control unit 90 in response to input image data to form an image pattern of ink dots on an ink receiver 80. The ink jet print head module 10 disposes ink drops to form a swath of ink dots on the ink receiver 80.

In another embodiment, a page-wide ink jet print head module 10 is formed by a print head bar or an assembly of print head modules. The ink jet print head module 10 remains still during printing while the ink receiving media is transported along the slow scan direction under the ink jet print head module 10. The ink jet system and methods are compatible with different print head arrangements known in the art. For example, the system and methods are applicable to a single pass ink jet printer with offset ink jet modules disclosed in the commonly assigned U.S. Pat. No. 5,771,052, the content of which is incorporated by reference herein.

Figure 2:
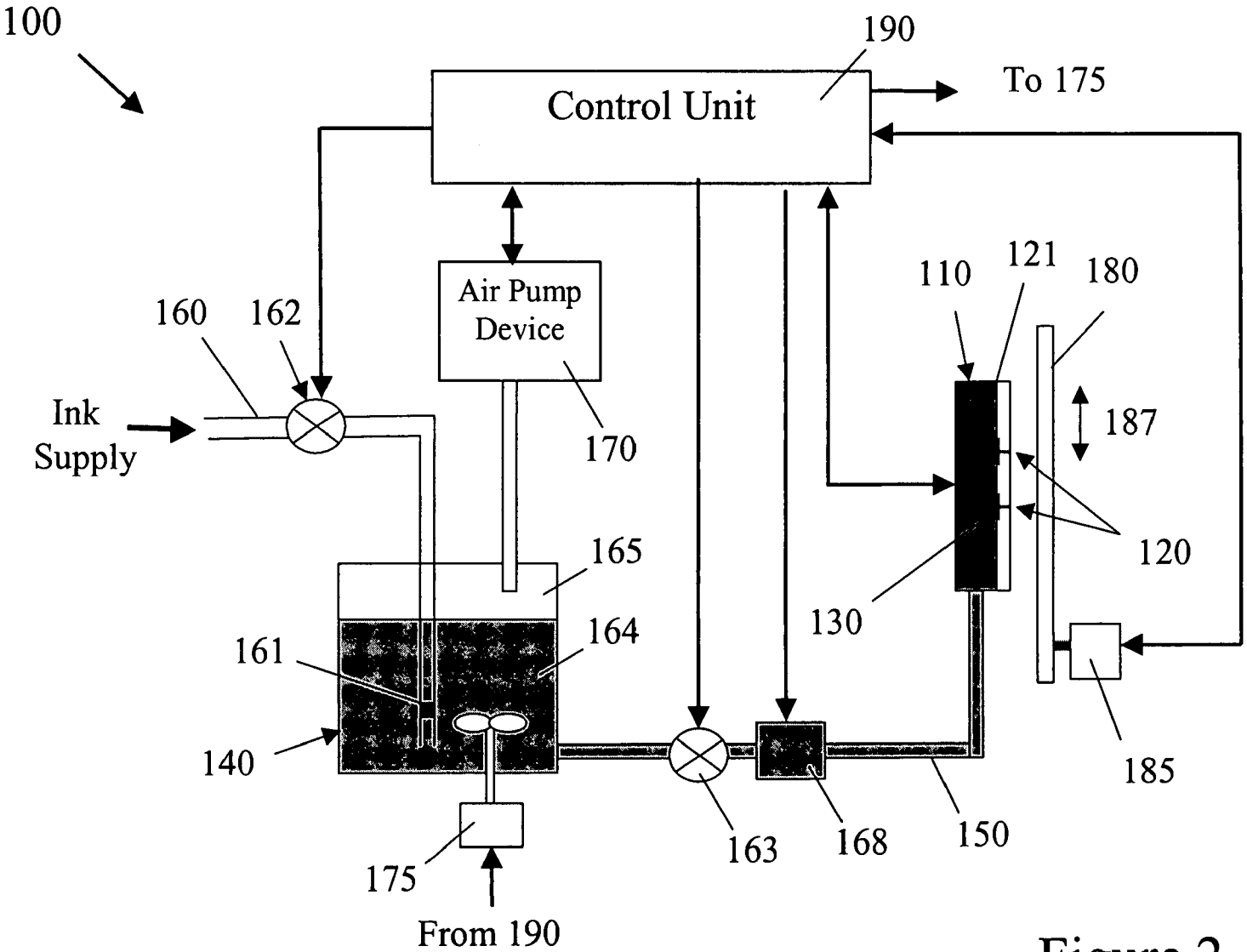
FIG. 2 illustrates an alternative implementation of an ink jet printing system configured to remove dissolved gas from the ink.

In another embodiment, FIG. 2 illustrates an ink jet printing system 100 that includes an ink jet print head module 110 having a plurality of ink nozzles 120 on a nozzle plate 121, a fluid conduit 130 in the ink jet print head module 100 for supplying ink to the ink nozzles 120, a meniscus control reservoir 140 capable of removing gas from the ink body, an ink passage 150 for supplying ink from the meniscus control reservoir 140 and the fluid conduit 130. In operation, the fluid conduit 130 is substantially fully wet with the ink fluid. The ink fluid contained in the fluid conduit 30 does not contain any substantial free surface.

The meniscus control reservoir 140 holds an ink body 164 and a space 165 above. A large free surface is formed over the ink body 164. The meniscus control reservoir 140 includes an ink-feeding path 160 having an ink filter 161 that supplies ink to the meniscus control reservoir 140. The ink-feeding path can be opened or closed by a valve 162. An ink pump 168 pumps the ink in the meniscus control reservoir 140 to the fluid conduit 130 along the ink passage 150. The ink flow along the ink passage 150 can be shut off a valve 163. The operations of the valves 162, 163 and the ink pump 168 are under the control of the control unit 190. The valve 162 or valve 163 can be a check valve, a variable valve, a solenoid valve, a servo valve, etc. The valves 162, 163 can be manually operated in degassing operations.

When the fluid communications between the ink body 164 and the outside of the meniscus control reservoir 140 are shut off by the valves 162, 163, a partial vacuum can be created in the space 165 by a air pump device 170 that pulls air out of the space 165 under the control of the control unit 190. The air pressure in the space 165 over the ink body 164 in the ink reservoir 140 is typically reduced to −8 inches of water to 0.001 bar. When partial vacuum is created in the space 165, gas or vapor dissolved in the ink body 164 will migrate within the ink body 164, across the ink-air interface to the space 165. As a result, the concentration of the dissolved gas is reduced in the ink body 164. During the gas removal, the ink body 164 can be stirred by a stirrer 175, which increases gas-removal efficiency by bringing the dissolved gas or vapor to the ink-air interface as well as increasing the surface area of the ink-air interface. Typically, the degassing operations are conducted in a non-printing mode so that the partial vacuum in the meniscus control reservoir 140 will not affect the meniscus pressure at the ink nozzles 120. During printing, the meniscus pressure at the ink nozzle 120 need to be properly maintained by controlling the air pump device 170 and the free surface of ink body 164. Typically, the air pressure in the space 165 is controlled slightly below atmospheric pressure (e.g. at −1 inch to −4 inches of water).

What is claimed is:

1. A drop ejection system, comprising:

a drop ejection head comprising a nozzle for ejecting a fluid;

a first reservoir to hold the fluid;

a first fluid path that connects fluid in the first reservoir with the drop ejection head;

a second reservoir to hold the fluid and have a space above the fluid;

a second fluid path that connects fluid in the second reservoir with the first reservoir; and a controllable air pump coupled to an upper portion of the second reservoir to produce a partial vacuum in the space above the fluid in the second reservoir without a vacuum element contacting the fluid.

2. The drop ejection system of claim 1, wherein the partial vacuum in the upper portion of the second reservoir enables the extraction of dissolved air or dissolved vapor from the fluid in the second reservoir.

3. The drop ejection system of claim 1, further comprising a valve to shut off the second fluid path from the second reservoir to the first reservoir.

4. The drop ejection system of claim 1, further comprising a stirring device to stir the fluid in the second reservoir to assist extraction of dissolved air from the fluid.

5. The drop ejection system of claim 1, further comprising a pump to pump the fluid from the second reservoir to the first reservoir through the second fluid path.

6. The drop ejection system of claim 1, further comprising a fluid-feeding path for providing fluid to the lower portion of the second reservoir, wherein the fluid-feeding path can be closed when the partial vacuum is generated in the upper portion of the second reservoir.

7. The drop ejection system of claim 1, wherein the drop ejection head further comprises a fluid conduit that can supply the ink received from the first reservoir to the nozzles.

8. The drop ejection system of claim 1, wherein the drop ejection head is movable without requiring movement of the second reservoir.

9. The drop ejection system of claim 1, further comprising a control unit that controls the air pump to produce the partial vacuum.

10. The drop ejection system of claim 9, wherein the control unit controls the air pump in response to one or more properties of the fluid.

11. The drop ejection system of claim 1, wherein the fluid includes one or more of a dye-based ink, a pigment-based ink, a hot-melt ink, a colorant, a paint, a polymer solution, a solvent, a colloidal suspension, or a metal.

12. The drop ejection system of claim 1, wherein the drop ejection head comprises one or more fluid ejection actuators that can actuate fluid ejection through the nozzles.

13. The drop ejection device of claim 12, wherein the fluid ejection actuator includes a piezoelectric transducer or a heater.

14. The drop ejection device of claim 1, wherein a surface of fluid in the first reservoir controls the meniscus pressure at the nozzles in the drop ejection head.

15. A method of removing dissolved gas in a fluid ejection system, comprising:

providing a fluid in a second reservoir that is in fluid communication with a first reservoir;

producing a partial vacuum in a space above the fluid in the second reservoir using an air pump without a vacuum element contacting the fluid;

supplying the fluid in the second reservoir to the first reservoir, the first reservoir having a space above the fluid; and supplying the fluid in the first reservoir to a drop ejection head.

16. The method of claim 15, wherein the partial vacuum enables extraction of dissolved air or dissolved vapor from the fluid in the second reservoir.

17. The method of claim 15, further comprising shutting off the fluid communication to or from the second reservoir.

18. The method of claim 15, further comprising stirring the fluid in the second reservoir.

19. The method of claim 15, wherein producing a partial vacuum is dependent on one or more properties of the fluid.

20. The method of claim 19, further comprising pumping the fluid from the second reservoir to the first reservoir.

21. The method of claim 15, wherein the fluid includes one or more of a dye-based ink, a pigment-based ink, a hot-melt ink, a colorant, a paint, a polymer solution, a solvent, a colloidal suspension, or a metal.

22. The method of claim 15, further comprising providing fluid to the second reservoir through a fluid-feeding path that can be shut off during producing the partial vacuum in the space above the fluid in the second reservoir.

23. The method of claim 15, further comprising translating the drop ejection head relative to a receiver without moving the second reservoir; and ejecting fluid drops from the fluid ejection head to form a pattern on the receiver.

24. The method of claim 15, further comprising controlling meniscus pressure of nozzles in the drop ejection head by the fluid in the first reservoir.

25. A drop ejection system, comprising:

a drop ejection head comprising a nozzle for ejecting a fluid;

a first reservoir to hold the fluid;

a first fluid path that connects the fluid in the first reservoir with the drop ejection head;

a second reservoir to hold the fluid and have a space above the fluid;

a second fluid path that connects the fluid in the second reservoir with the first reservoir; and a controllable air pump coupled to an upper portion of the second reservoir to produce a partial vacuum between about −8 inches of water and 0.0001 bar in the space above the fluid in the second reservoir.

* * * * *